US006929498B2

(12) United States Patent
Tan

(10) Patent No.: US 6,929,498 B2
(45) Date of Patent: Aug. 16, 2005

(54) ELECTRICAL CONNECTOR WITH MOUNTING MEMBER AND METHOD OF MAKING SAME

(75) Inventor: Shijie Tan, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/945,736

(22) Filed: Sep. 20, 2004

(65) Prior Publication Data

US 2005/0064754 A1 Mar. 24, 2005

(30) Foreign Application Priority Data

Sep. 19, 2003 (TW) ..... 92125992 A

(51) Int. Cl.[7] ..... H01R 13/625
(52) U.S. Cl. ..... 439/342; 439/566
(58) Field of Search ..... 439/342, 566, 439/736; 264/272.11

(56) References Cited

U.S. PATENT DOCUMENTS 5,057,031 A * 10/1991 Sinclair ..... 439/342
5,092,789 A * 3/1992 Sinclair ..... 439/342
6,471,533 B2 * 10/2002 Lai et al. ..... 439/342
6,623,298 B2 * 9/2003 Lin et al. ..... 439/342
6,743,039 B2 * 6/2004 Shirai et al. ..... 439/342

* cited by examiner

*Primary Examiner*—Tho D. Ta
(74) *Attorney, Agent, or Firm*—Wei Te Chung

(57) ABSTRACT

A socket connector (30) comprises a base (32) with a mounting member (33) molded onto the base. The mounted member can be soldered on a PCB (40), thereby to secure the socket connector on the PCB. Additionally, a method of molding the mounting member onto the base comprises the following steps: forming the mounting member, positioning the mounting member in a base mold (70) having an upper mold (70*a*) and a lower mold (70*b*), closing the upper mold and the lower mold, inserting plastic material into the base mold, cooling the base mold, separating the upper mold and the lower mold, extracting the formed base with a part of the mounting member molded into the housing. The mounting member is molded onto the base, thereby to avoid incidence of damage during insertion of the mounting member onto the base.

5 Claims, 10 Drawing Sheets

ELECTRICAL CONNECTOR WITH MOUNTING MEMBER AND METHOD OF MAKING SAME

BACKGROUND OF THE INVENTION

1. Field of the Invention

The present invention relates to the art of electrical connectors and to the art of methods of making the electrical connectors, and more particularly to a socket connector to be soldered on a printed circuit board (PCB) and to a method of making the socket connector.

2. Description of the Prior Art

With the trend toward high-density of conductive terminals in socket connectors, many socket connectors are electrically attached to a substrate, such as a PCB, generally via ball grid array (BGA) type package. This solution can reduce a terminal pitch to 0.050 inch. Except for the socket connectors, the PCB simultaneously carries other components in order to enhance integrated characteristics of the PCB. When a BGA-type socket connector has first been mounted on a side of the PCB, other components are consequently soldered on the other side of the PCB in a high temperature environment. Said high temperature is prone to soft the solder balls, through which the socket connector is mounted on the side of the PCB. If this happens, the socket connector is liable to lose balance and slant away from the original position. As a result, mechanism and electrical engagement between the socket connector and the PCB is decreased.

Referring to FIGS. 17 and 18, in order to resolve the problem, a mounting member is applied to the socket connector 90 and comprises a retention section 982 and a mounting section 980, the retention section 982 of the mounting member 98 is disposed in a recess 920 defined in a base 92 of the socket connector 90. When the socket connector 90 is mounted on a side of a PCB (not shown), the mounting section 980 of the mounting member 98 is simultaneously soldered on the side of the PCB. Then other components are soldered on the other side of the PCB, the mounting member 98 stabilizes the socket connector 90 on the side of the PCB. Stability of engagement between the socket connector 90 and the PCB is improved.

However, the mounting member 98 is inserted into the recess 920 by an operator, nicety of said insertion operation is relatively low. Further, the base 92 of the socket connector 90 has a thin thickness, sides of the recess 920 are liable to be damaged as the retention portion 982 is inserted into the recess 920.

Accordingly, a new socket connector and a method of making the same that solve the above problems are desirable.

SUMMARY OF THE INVENTION

Accordingly, an object of the present invention is to provide a socket connector able to be stabilized on a side of a PCB as other component or components are mounted on the other side of the PCB in a heat environment.

Another object of the present invention is to provide a method of making the socket connector, thereby to avoid incidence of damage during assembly of a mounting member onto a base of the socket connector.

To fulfill the above objects, a socket connector is applied according to the present invention. The socket connector comprises a base, a plurality of terminals received in the base, a cover slidably mounted on the base, an urging member embedded in the base and the cover for urging the cover to move relative to the base, and a mounting member molded onto the base. A solderable member is formed on each terminal, for being soldered on a PCB. The socket connector is thereby electrically attached to the PCB. Simultaneously, the mounting member has a relatively large soldering surface attached to the PCB, thereby to enhance attachment of the socket connector to the PCB.

Additionally, a method of molding the mounting member onto the base is also applied according to the present invention. The method comprises the following steps: forming the mounting member, positioning the mounting member into a base mold, closing the base mold, inserting plastic material into the base mold, cooling the base mold, separating the base mold, and extracting the formed base with a part of the mounting member molded onto the formed base. The mounting member is safely molded and attached to the base, thereby to avoid incidence of damage during insertion of the mounting member onto the base of the socket connector.

Other objects, advantages and novel features of the present invention will become more apparent from the following detailed description when taken in conjunction with the accompanying drawings, in which:

DESCRIPTION OF PREFERRED EMBODIMENTS OF THE INVENTION

Reference is now made to the drawings to describe the invention in detail.

Figure 1:
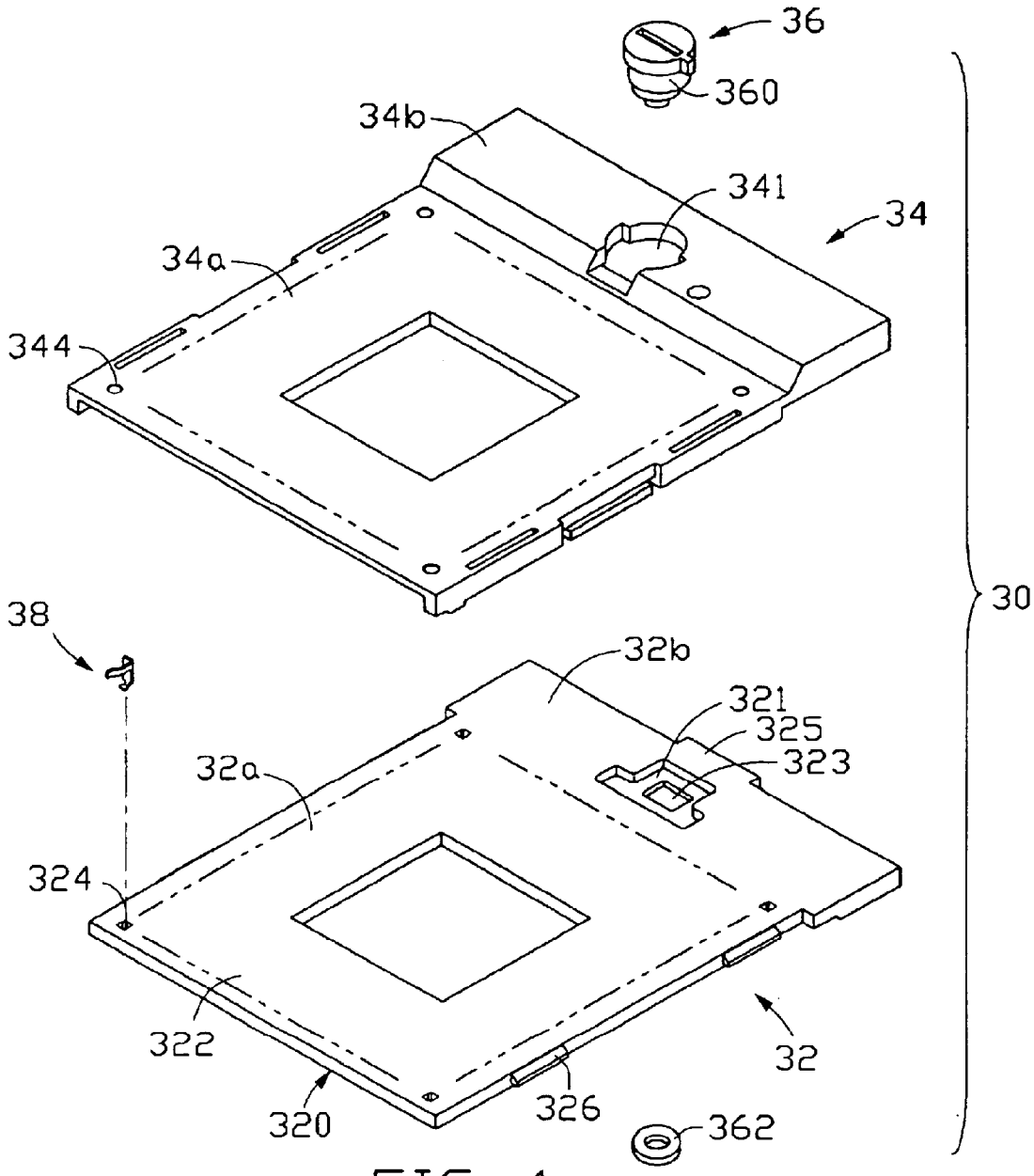
FIG. 1 is an exploded, isometric view of a socket connector according to the present invention.

Referring to FIG. 1, there is shown an exploded, isometric view of a socket connector 30 according to the present invention. The socket connector 30 is mainly applied for electrically interconnecting an IC package, such as a CPU, with a PCB 40. The socket connector 30 is mounted on the PCB 40 via surface mounting technology (SMT). The socket connector 30 comprises a parallelepiped dielectric base 32, a plate like dielectric cover 34 slidably mounted on the base 32, a plurality of terminals 38 secured in the base 32, an driving mechanism 36 transplanted in the base 32 and the cover 34.

The base 32 comprises a rectangular plate like first body 32*a* and a first head portion 32*b* extending from one end of the first body 32*a*.

A mounting surface 320 is defined on the base 32 toward the PCB 40. A mating surface 322 is defined on the base 32 opposite the mounting surface 320, for supporting the cover 34 thereon. A rectangular array of passages 324 is defined in the first body 32*a* between the mating surface 322 and the mounting surface 320, each passage 324 securing a corresponding terminal 38 therein. A pair of blocks 326 is formed each lateral side of the base 32. A step-like recess 321 is defined in a center of the first head portion 32*b*, for receiving a part of the driving mechanism 36. A rectangular hole 323 is defined in a bottom of the recess 321. A protrusion 325 extends outwardly from a middle of an extending end of the first head portion 32*b*.

Figure 2:
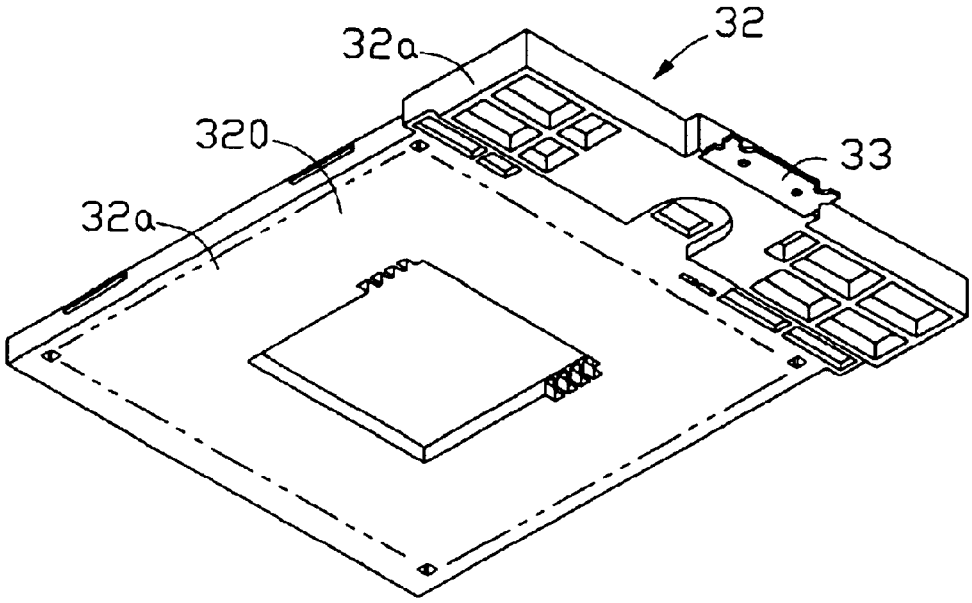
FIG. 2 is a reversed, isometric view of a base of the socket connector shown in FIG. 1.
Figure 3:
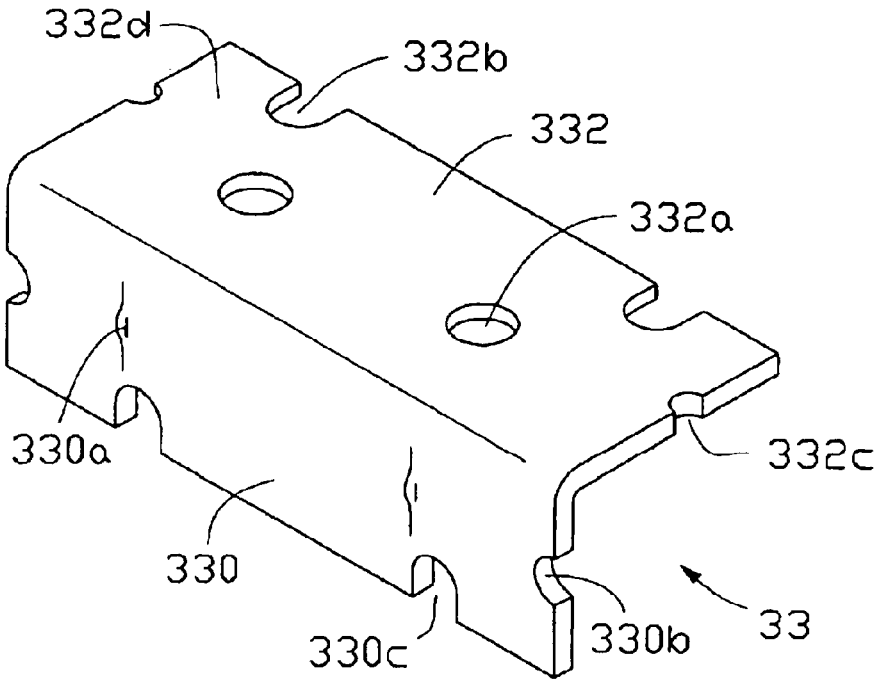
FIG. 3 is an isometric view of a mounting member of the socket connector of FIG. 1.
Figure 4:
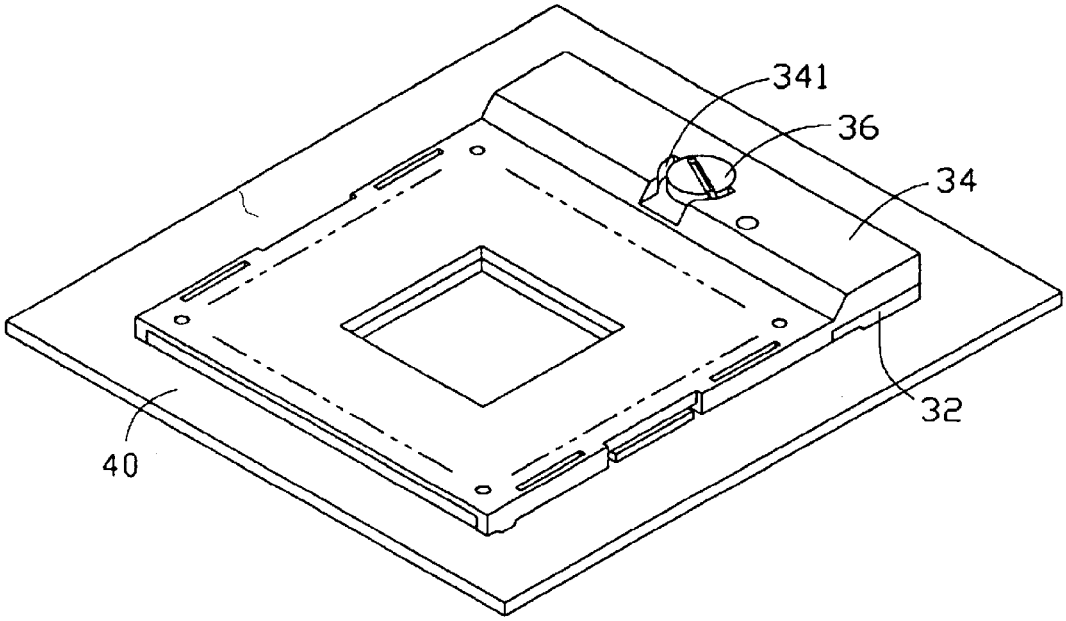
FIG. 4 is an isometric view of the assembled socket connector attached to a side of a PCB.
Figure 5:
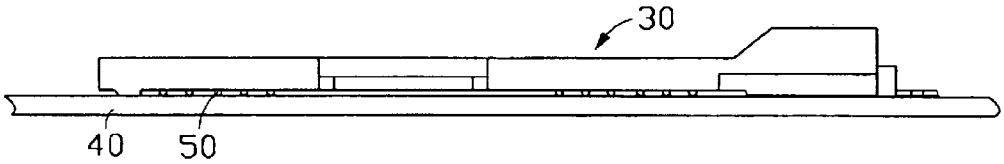
FIG. 5 is a side view of FIG. 4.
Figure 6:
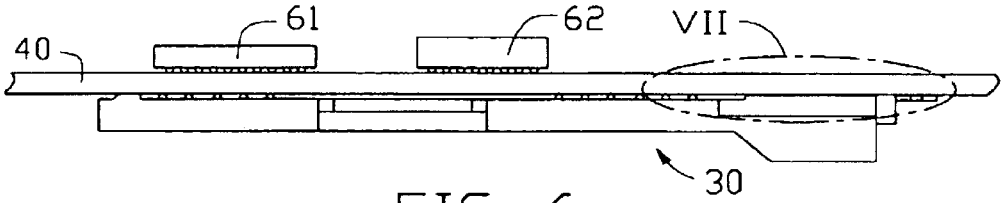
FIG. 6 is similar to FIG. 5, but showing the reversed PCB and two components being attached to the other side of the PCB.
Figure 7:
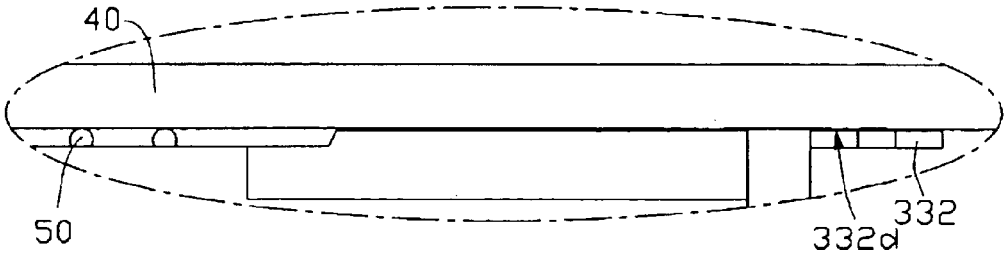
FIG. 7 is an enlarged view of a circled VII in FIG. 6.

Referring to FIGS. 2 and 3, a mounting member 33 comprises a molding section 330 molded in the protrusion 325 and a mounting section 332 extending perpendicularly from the molding section 330 in parallel with the mounting surface 320 of the first body 32. The mounting section 332 has a relatively larger soldering surface 332*d* substantially flush with the mounting surface 320. A pair of apertures 332*b* is defined the mounting section 332, being spaced along a longitudinal centerline of the mounting section 332. Two pairs of cutouts 332*c* are defined at edges of the mounting section 332. The molding section 330 is formed with a protruding portion 330*a* at a center of the molding portion 330. A pair of positioning cutouts 330*b* is defined in middles of opposite edges of the molding section 330. A pair of notches 330*c* is defined in an edge of the molding section 330.

Referring to FIG. 1, the cover 34 is formed from dielectric material and comprises a second rectangular body 34*a* and a second head portion 34*b*, respectively corresponding to the first body 32*a* and the first head portion 32*b* of the base 32. A plurality of holes 344 is defined through the body 34*a*, each hole 344 aligning with a corresponding passage 324. A pair of accommodating recesses (not shown) is defined in each lateral side of the cover 34. A window 341 is defined a center of the second head portion 34*b* of the cover 34, aligning with the hole 323 of the base 32.

The driving mechanism 36 comprises an urging body 360 of cam function and a washer 362 adapted to secure to a end of the urging body 360.

In assembly, the terminals 38 are each secured in a corresponding passage 324 of the base. The cover 34 is mounted on the base 32, the protrusions 326 of the base 32 engaging in the accommodating recesses of the cover 34. The urging body 360 is placed in the recess 321 of the base 32 and the window 341 of the cover 34, the bottom of the urging body 360 extending beyond the rectangular hole 323. The washer 362 is immovably attached to the bottom of the urging body 360 and abuts against the mounting surface 320 around the hole 323, thereby securing the urging body 360 in the recess 321 of the base 32 and the window 341 of the cover 34.

Referring to FIGS. 4, 5, 6 and 7, in use, a plurality of solder balls 50 is each disposed on a corresponding terminal. The socket connector 30 is mounted a side of the PCB 40 via SMT technology, the solder balls 50 being soldered on the side of the PCB 40. Simultaneously, the mounting section 332 of the mounting member 33 is coated with a layer of solder past and soldered on the side of the PCB 40. Attachment of the mounting member 33 on the side of the PCB 40 facilitates securing the socket connector 30 on the side of the PCB 40. Further, the mounting section 332 has a relatively large soldering surface 332*d*, the relatively large soldering surface 332*d* is soldered on the side of the PCB 40, and the socket connector 30 is further secured on the side of the PCB 40. When other electrical component or components 61, 62 are required to be mounted on the other side of the PCB 40, the socket connector 40 can be stabilized on the side of the PCB and prevented slanting or falling from the side of the PCB 40. Mechanical and electrical engagement between the socket connector 30 and the PCB 40 is assured.

Figure 8:
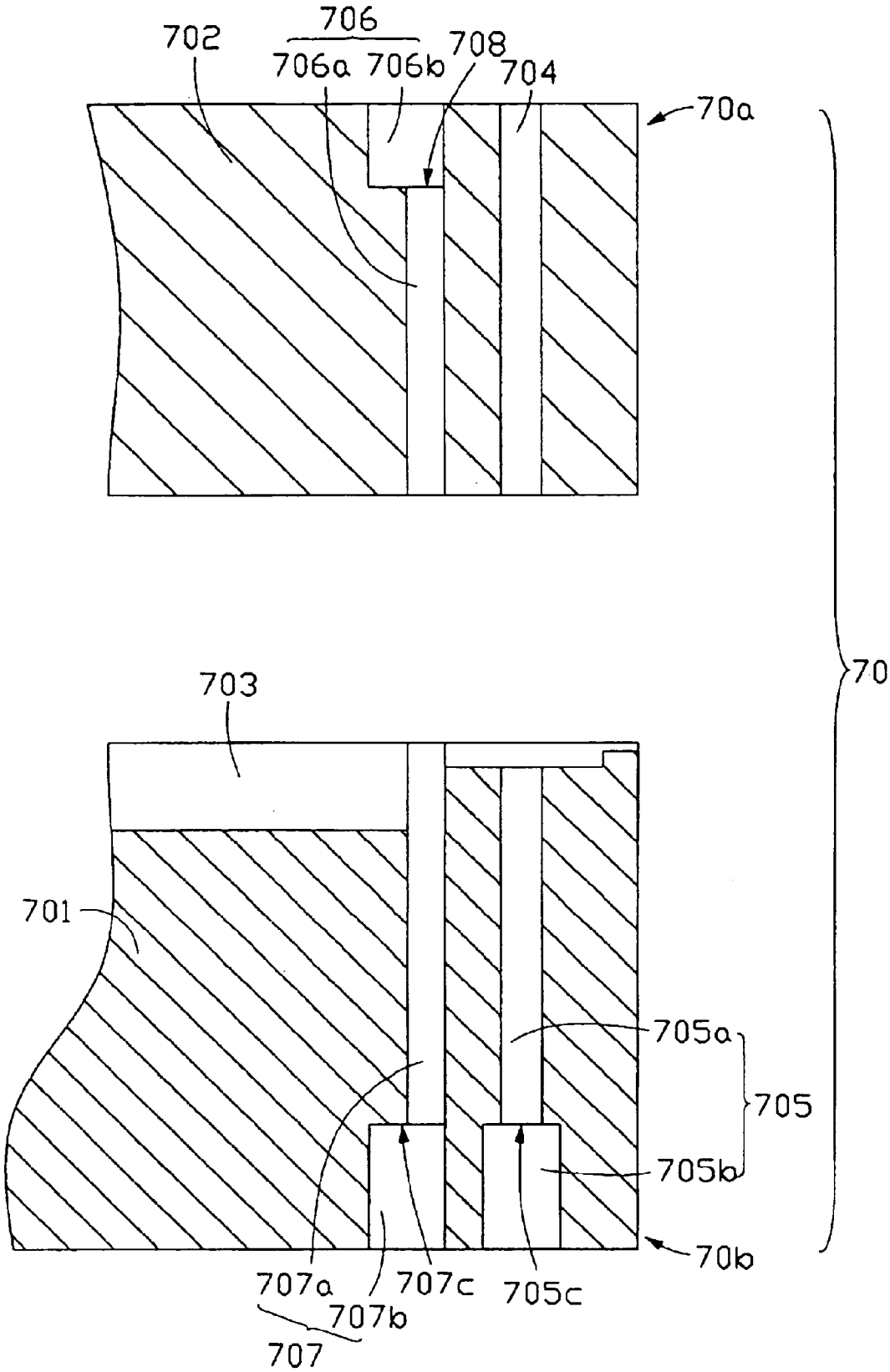
FIG. 8 is a cross sectional view of a base mold, showing an upper mold of the base mold separated from a lower mold of the base mold.
Figure 9:
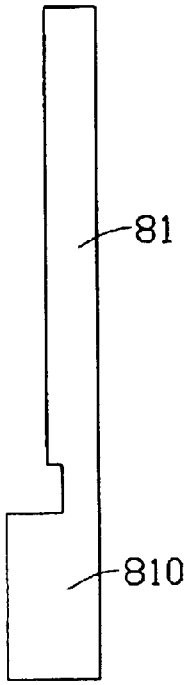
FIG. 9 is a front view of a first sealing member.
Figure 10:
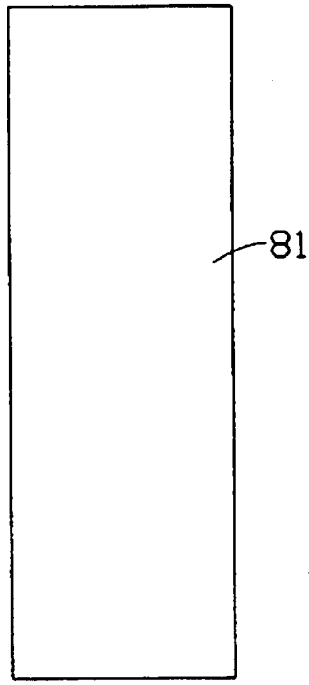
FIG. 10 is a left view of the first sealing member.
Figure 11:
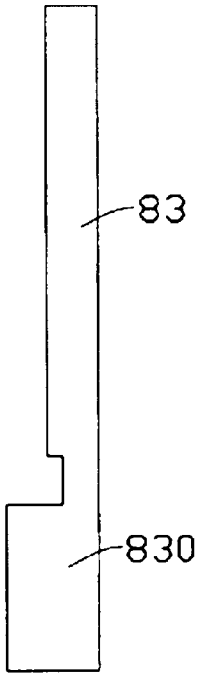
FIG. 11 is a front view of a second sealing member.
Figure 12:
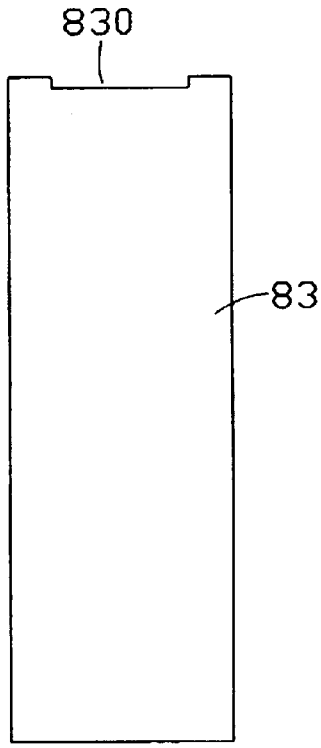
FIG. 12 is a left view of the second sealing member.

Additionally, the present invention also supplies a method of disposing the mounting member 33 onto the base 32. Referring to FIG. 8, a set of base molds 70 is applied and comprises an upper mold 70*a* and a lower mold 70*b*.

The upper mold 70*a* comprises an upper mold core 702. A first positioning channel 704 is defined in the upper mold core 702. A first accommodating slot 706 is defined in the upper mold core 702 parallel to the first positioning channel 704. The slot 706 comprises a narrow slot 706*a* and a wide slot 706*b* communicating with the narrow slot 706*a*. A shoulder surface 708 is formed between the narrow slot 706*a* and the wide slot 706*b*.

The lower mold 70*b* comprises a lower mold core 701. A mold cavity 703 is defined in the lower mold core 701 and dimensioned to the base 32. A second accommodating slot 707 and a second positioning channel 705 are defined in the lower mold core 701, respectively corresponding to the first accommodating slot 706 and the first positioning channel 704 of the upper mold core 702. The second positioning channel 705 comprises a narrow channel 705*a* and a wide channel 705*b*. A positioning shoulder 705*c* is formed between the narrow channel 705*a* and the wide channel 705*b* the second accommodating slot 707 comprising a narrow accommodating slot 707*a* and a wide accommodating slot 707*b*. A stopping shoulder 707*c* is formed between the narrow accommodating slot 707*a* and the wide accommodating slot 707*b*.

Referring to FIGS. 9, 10, 11, 12 and 13, further, first and second sealing members 81, 83 is supplied for blocking the first accommodating slot 706 and the second accommodating slot 707. The first sealing member 81 has a similar configuration with the second sealing member 83. The only difference is that the second sealing member 83 defines a recess 830 at a top thereof. The first and second sealing members 81, 83 are each formed with an enlarged position portion 810, 830. A pair of positioning posts 85 is supplied to position the mounting member 33 in the mold cavity 703 of the lower mold core 701. Each post 85 is formed with a enlarged end 850.

The method of securing the mounting member 33 onto the base 32 comprises the following steps:

Forming step: the mounting member 33 is stamped from a sheet of metal material and shaped as shown in FIG. 3.

Figure 13:
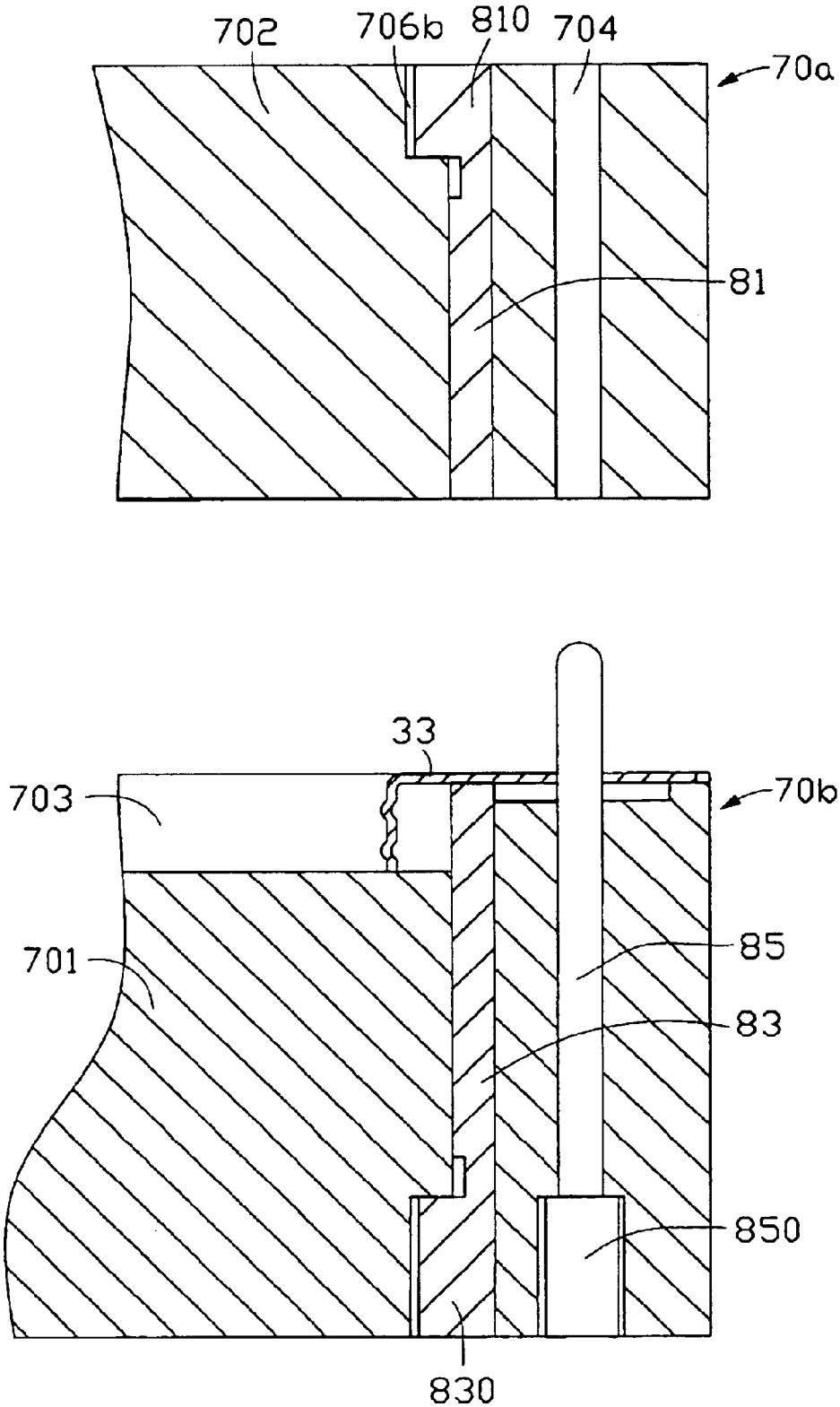
FIG. 13 is similar to FIG. 8, but the first and second sealing members secured in the base mold, a post inserted in the lower mold and the mounting member positioned in the lower mold.

Positioning step: referring to FIGS. 2 and 13, the first and second sealing members 81, 83 are inserted and sealedly secured in the first and second accommodating slots 706, 707, the enlarged positioning portions 810, 830 of the first and second sealing members 81, 83 engaging the shoulder surfaces 708, 707*c*. The pair of posts 85 is respectively inserted and positioned in the positioning channels 705, the enlarged ends 850 of the pair of posts 85 engaging the shoulders 705*c*. The mounting member 33 is inserted and secured in the mold cavity 703 of the lower mold core 70*b*, the mounting section 332 secured in the recess 830 of the second sealing member 83. During the insertion of the mounting member 33, the posts 85 are received in the apertures 332*a* to facilitate guidance of the mounting member 33.

Figure 14:
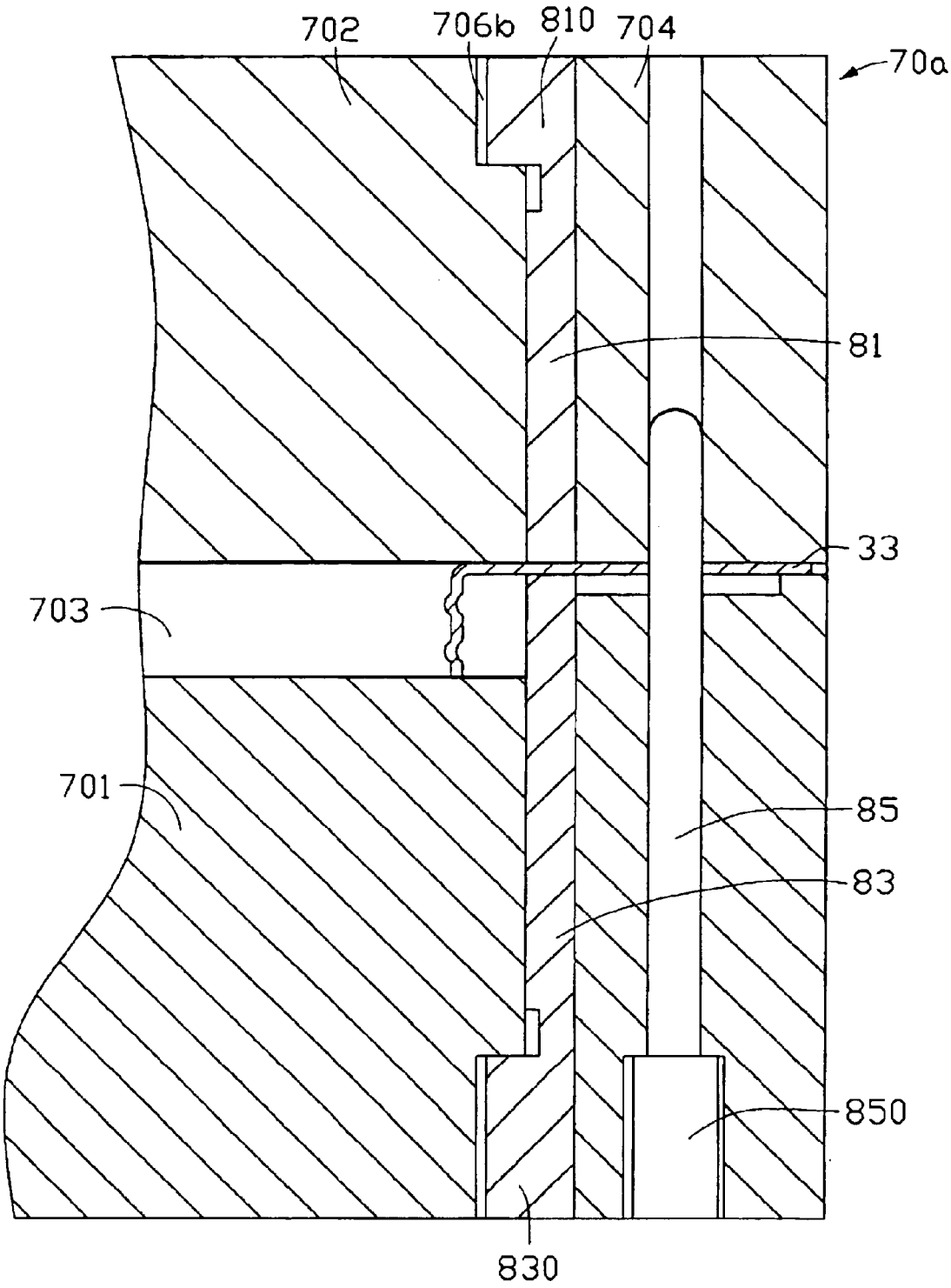
FIG. 14 is an assembled view of FIG. 13.

Closing step: referring to FIG. 14, the upper mold 70*a* and the lower mold 70*b* are placed toward each other until closed together.

Inserting step: the melted dielectric material is inserted into the cavity 703 of the lower mold 70*b*.

Figure 15:
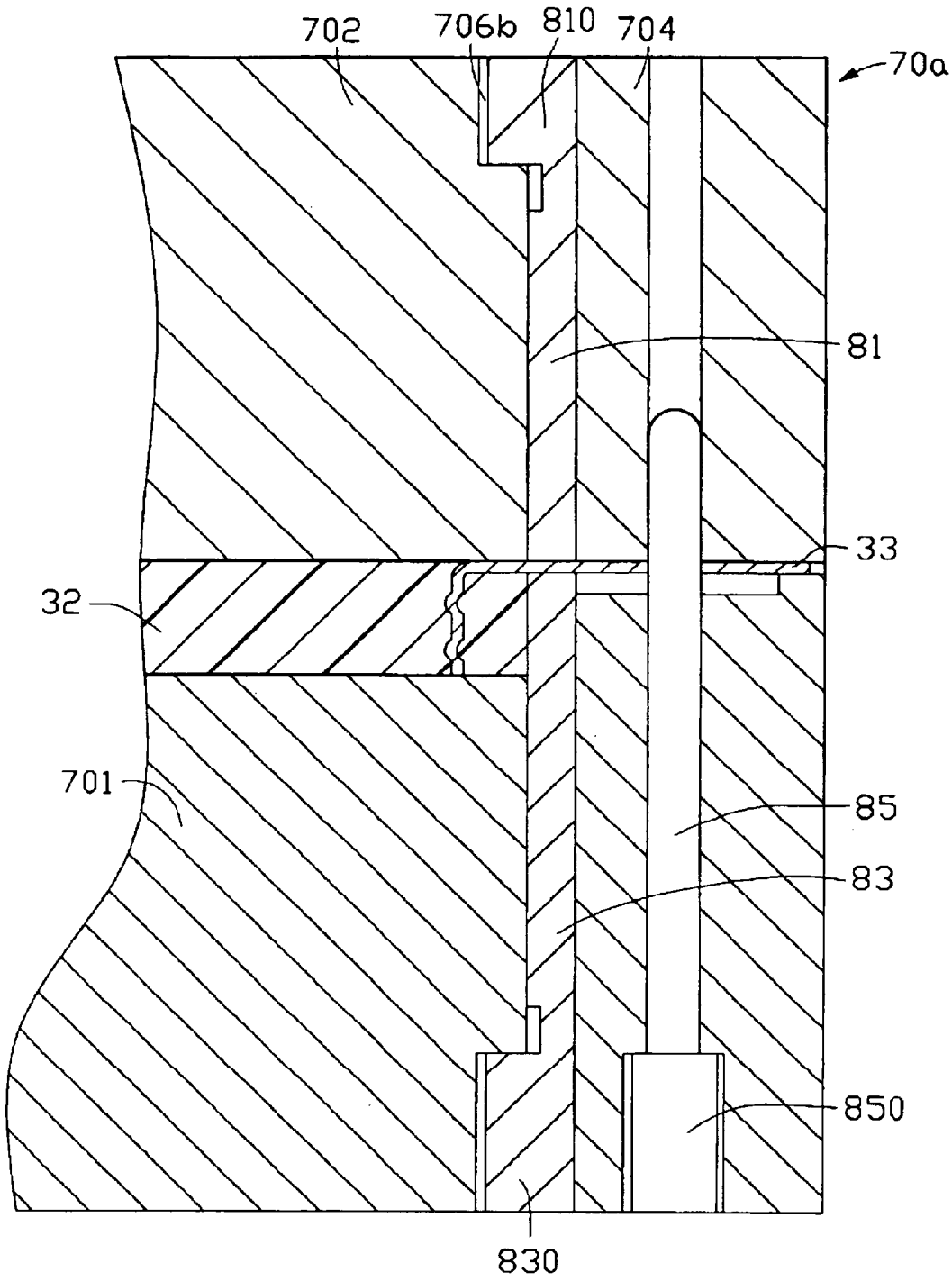
FIG. 15 is similar to FIG. 14, but showing melt material inserted into the base mold.

Cooling step: referring to FIG. 15, the set of molds 70 is cooled down to form the base 32 and integrate the mounting member 33 onto the base 32.

Figure 16:
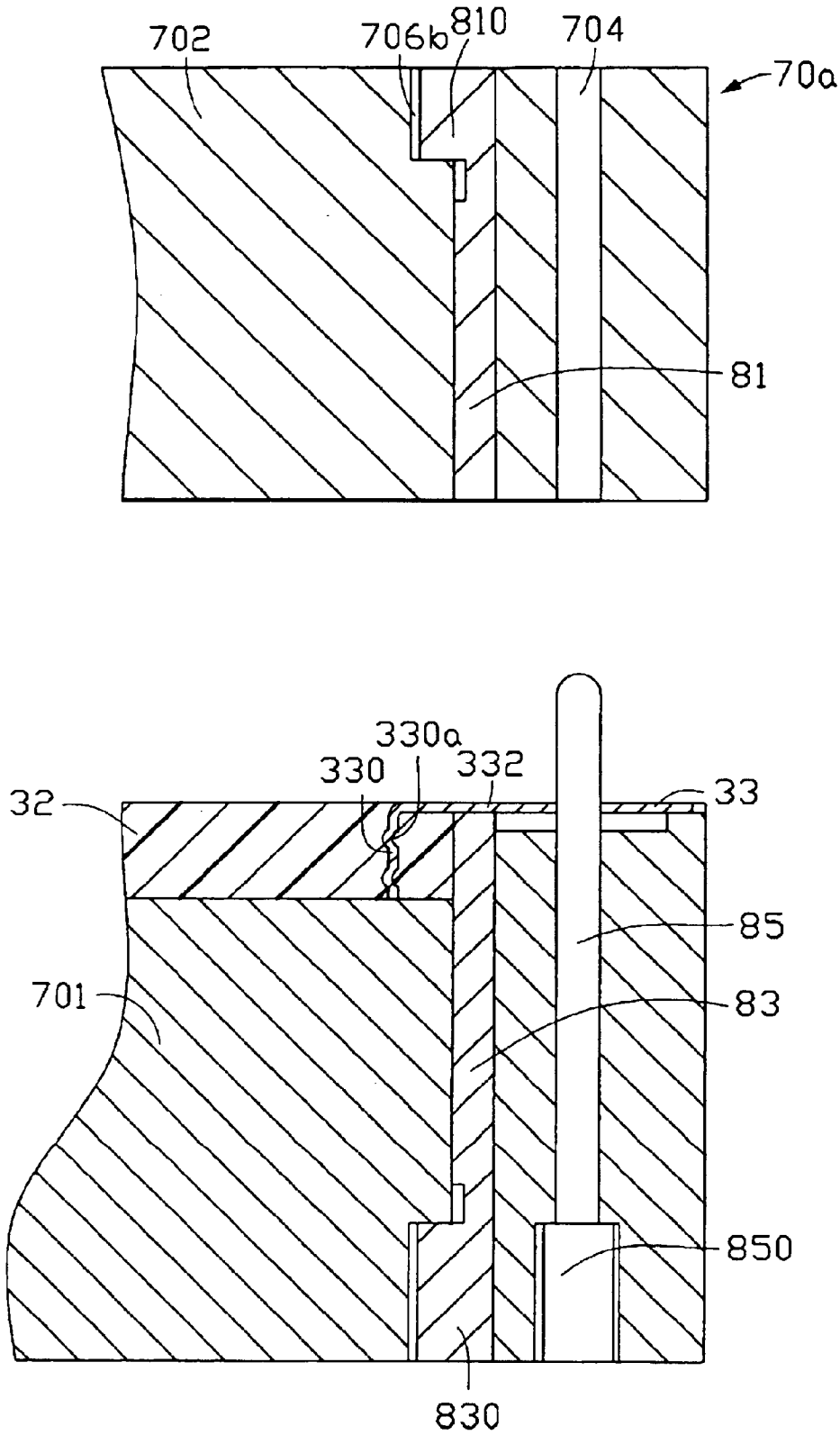
FIG. 16 is similar to FIG. 15, but showing the upper mold separated from the lower mold.
Figure 17:
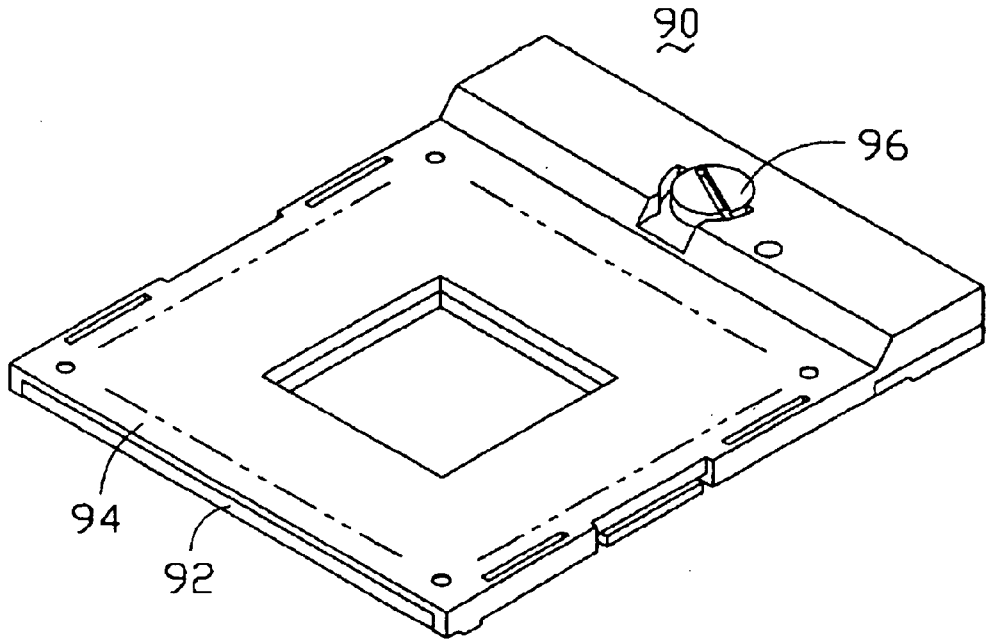
FIG. 17 (PRIOR ART)
FIG. 17 is an assembled, isometric view of a conventional socket connector.
Figure 18:
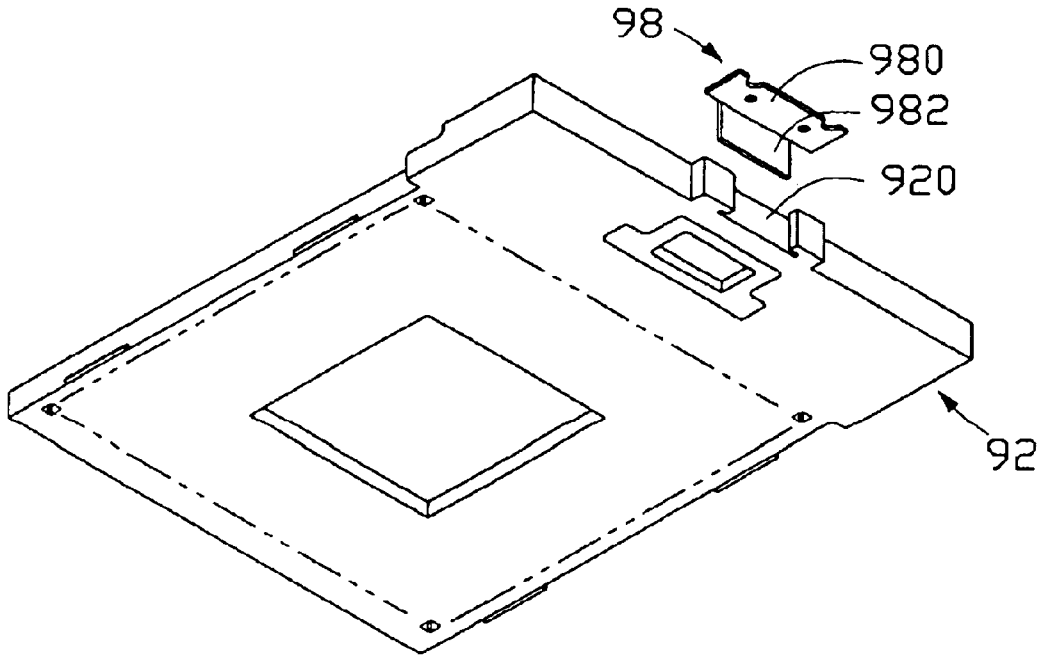
FIG. 18 (PRIOR ART)
FIG. 18 is an isometric view of a base of the socket connector of FIG. 17, showing a mounting member ready to be inserted into the base.

Separating step: referring to FIG. 16, the upper mold 70*a* and the lower mold 70*b* are separated from each other.

Extracting step: the base 32 is extracted out from the cavity 703 of the lower mold 70*b*, the mounting member 33 molded onto the base 32. The step can also be fulfilled at the time of the separating step, especially in a mass production circumstance.

With the protrusions 330*a* and the notches 330*b* of the mounting member 33, the molding section 330 can be safely molded onto the base 32, thereby to avoid incidence of damaging during insertion of the mounting member 33 onto the base 32.

Furthermore, although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector for electrically interconnecting with a substrate, the electrical connector comprising:

a dielectric base defining a mounting surface and a mating surface and a plurality of passages between the mounting surface and the mating surface;

a plurality of terminals each received in a corresponding passage;

a plurality of solderable members each electrically connected with a part of a corresponding terminal, at least part of each of the plurality of solderable members extending outside the mounting surface;

a mounting member molded into the base and comprising a mounting surface to be mounted on the substrate;

a printed circuit board electrically engaging with the solderable members and mechanically attaching with the mounting surface so as to assure engagement of the solderable members with the printed circuit board; and a cover defining a plurality of through holes each aligning with a corresponding passage of the base, and an urging mechanism adapted to drive the cover to move relative to the base;

wherein the mounting member comprises a first section and a second section bent from the first section;

wherein the first section defines at least one notch at edges thereof and the second section defines at least one hole;

wherein the first section forms at least one protrusion;

wherein the first section is vertical to the second section.

2. The electrical connector of claim 1, wherein the cover defines a plurality of cutouts at opposite sides thereof and the base forms positioning protrusions corresponding to the cutouts of the cover.

3. An electrical connector assembly comprising:

an electrical connector comprising a base, a plurality of conductive members received in the base, a cover slidably mounted on the base and urging means for urging the cover to move relative to the base between a first position and a second position;

a plurality of solderable members each electrically attached to a corresponding conductive member;

a mounting member integrally molded onto the base and defining a mounting surface; and a printed circuit board electrically engaging with the solderable members and mechanically attaching with the mounting surface so as to assure engagement of the solderable members with the printed circuit board;

wherein the mounting member comprises a first section and a second section extending from one end of the first section;

wherein the first section defines at least one notch at edges thereof, the second section defines at least one hole therein;

wherein the first section defines a plate with at least a protrusion and a through notch extending in a direction perpendicular to said plate, and wherein said first section is essentially circumferentially fully surrounded by the base.

4. The electrical connector assembly of claim 3, wherein the base defines an array of terminal-passages each receiving a corresponding conductive member.

5. The electrical connector assembly of claim 4, wherein the cover defines a plurality of cutouts at opposite sides thereof, the base forms positioning protrusions corresponding to the cutouts of the cover.

* * * * *